US007625334B2

(12) United States Patent
Corsini et al.

(10) Patent No.: US 7,625,334 B2
(45) Date of Patent: Dec. 1, 2009

(54) METHOD AND UNIT FOR FOLDING A LID REINFORCING FLAP OF A RIGID, HINGED-LID PACKET OF CIGARETTES

(75) Inventors: Andrea Corsini, Bologna (IT); Valerio Fiorini, Bologna (IT); Alessandro Minarelli, Bazzano (IT)

(73) Assignee: G.D Societa' per Azioni, Bologna (IT)

( * ) Notice: Subject to any disclaimer, the term of this patent is extended or adjusted under 35 U.S.C. 154(b) by 0 days.

(21) Appl. No.: 11/833,300

(22) Filed: Aug. 3, 2007

(65) Prior Publication Data

US 2008/0047234 A1 Feb. 28, 2008

(30) Foreign Application Priority Data

Aug. 3, 2006 (IT) ..... BO2006A0588

(51) Int. Cl.
*B31B 1/52* (2006.01)

(52) U.S. Cl. ..... 493/457; 493/210; 493/162; 493/399; 493/183

(58) Field of Classification Search ..... 493/162, 493/178, 182, 399, 400–401, 405, 416, 436–438, 493/180, 183, 453, 457, 210
See application file for complete search history.

(56) References Cited

U.S. PATENT DOCUMENTS 4,034,538 A 7/1977 Schmermund et al.
4,392,338 A * 7/1983 Fox ..... 53/462
4,487,596 A * 12/1984 Livens et al. ..... 493/125
4,918,908 A 4/1990 Focke et al.
5,052,993 A 10/1991 Focke et al.
5,070,681 A * 12/1991 Romagnoli ..... 53/566
5,151,073 A 9/1992 Focke et al.
5,607,382 A * 3/1997 Boriani et al. ..... 493/182
6,694,708 B2 * 2/2004 Brizzi et al. ..... 53/462
2002/0050130 A1 * 5/2002 Grossmann ..... 53/574
2005/0103654 A1 5/2005 Hennessy
2008/0283427 A1 * 11/2008 Polloni et al. ..... 206/268

FOREIGN PATENT DOCUMENTS

EP 1 466 844 10/2004
WO WO-2004/060774 7/2004

OTHER PUBLICATIONS

European Search Report in 07113741.8 dated Nov. 9, 2007.

* cited by examiner

*Primary Examiner*—Christopher Harmon
(74) *Attorney, Agent, or Firm*—Marshall, Gerstein & Borun LLP

(57) ABSTRACT

A method and unit for folding a reinforcing flap of the lid of a rigid, hinged-lid packet of cigarettes, wherein at least one reinforcing flap of the lid is folded 180° with respect to a blank and about a fold line onto the blank; the reinforcing flap is prefolded about the fold line by means of a first folding device having a movable folding body; and folding of the reinforcing flap about the fold line is completed by means of a second folding device having fixed folding rails.

18 Claims, 12 Drawing Sheets

METHOD AND UNIT FOR FOLDING A LID REINFORCING FLAP OF A RIGID, HINGED-LID PACKET OF CIGARETTES

CROSS-REFERENCE TO RELATED APPLICATIONS

This claims the benefit of Italian patent application No. BO2006A 000588, filed Aug. 3, 2006.

TECHNICAL FIELD

The present invention relates to a method and unit for folding a lid reinforcing flap of a rigid, hinged-lid packet of cigarettes.

BACKGROUND ART

Rigid, hinged-lid packets of cigarettes are currently the most marketed, by being easy to produce, easy and practical to use, and by effectively protecting the cigarettes inside.

A rigid, hinged-lid packet of cigarettes comprises a group of cigarettes wrapped in a sheet of foil packing material; and a rigid outer package housing the group of cigarettes. The outer package comprises a cup-shaped container housing the group of cigarettes and having an open top end; and a cup-shaped lid hinged to the container along a hinge to rotate, with respect to the container, between an open position and a closed position opening and closing the open end respectively. A collar is normally folded and connected to the inside of the container, so as to project partly outwards of the open end and engage a corresponding inner surface of the lid when the lid is in the closed position.

The lid of most known rigid packets of cigarettes has at least one reinforcing flap, which is folded 180° onto the inner surface of a front wall of the lid. On existing packing machines, the 180° fold of the lid reinforcing flap is the first fold made of the outer package blank, and is performed on a blank feed unit by means of fixed folding rails (helical folding devices).

A new type of rigid packet of cigarettes has recently been proposed, in which the lid both translates and rotates from the closed position to the open position and vice versa, and which has two lid reinforcing flaps which must be folded about two oblique, oppositely-inclined fold lines. The oblique fold lines being oppositely inclined lengthwise of the blank, however, at least one of the two reinforcing flaps cannot be folded 180° by a fixed folding rail (which cannot fold against the travelling direction of the blank).

Adapting an existing packing machine to produce a rigid packet of cigarettes of the above type is therefore complicated, particularly on account of the numerous structural and dimensional factors involved, and the need, obviously, to still ensure adequate access to all the component parts of the packing machine for maintenance and cleaning.

DISCLOSURE OF THE INVENTION

It is an object of the present invention to provide a method and unit for folding a lid reinforcing flap of a rigid, hinged-lid packet cigarettes, which are designed to also operate with a stack of superimposed collars, and, at the same time, are cheap and easy to implement.

According to the present invention, there are provided a method and unit for folding a lid reinforcing flap of a rigid, hinged-lid packet of cigarettes, as claimed in the attached Claims.

BRIEF DESCRIPTION OF THE DRAWINGS

A number of non-limiting embodiments of the present invention will be described by way of example with reference to the accompanying drawings, in which.

PREFERRED EMBODIMENTS OF THE INVENTION

Figure 1:
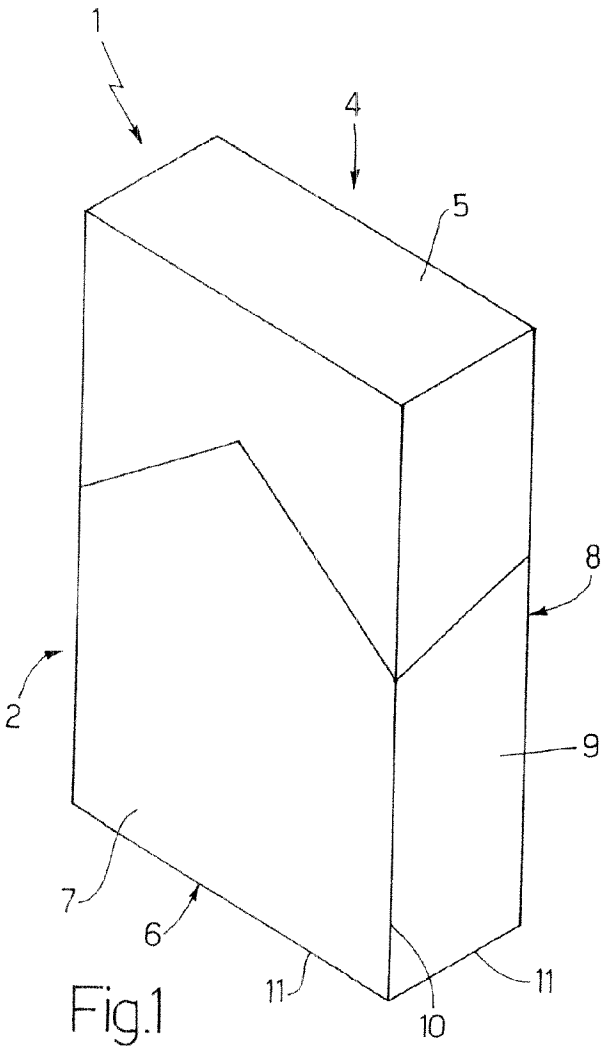
FIG. 1 shows a front view in perspective of a rigid packet of cigarettes in a closed configuration.

Number 1 in FIG. 1 indicates as a whole a rigid packet of cigarettes comprising a cup-shaped container 2, and an inner package 3 (FIG. 2) housed inside container 2. Inner package 3 is defined by a parallelepiped-shaped group of cigarettes, and by a sheet of foil packing material completely enclosing the group of cigarettes. Container 2 has an open top end, and a cup-shaped lid 4 connected to container 2 to rotate and translate, with respect to container 2, between a closed position (FIG. 1) and an open position (FIG. 2) closing and opening the open top end respectively.

When lid 4 is in the closed position, container 2 is in the form of a rectangular-section parallelepiped comprising a top wall 5 and a bottom wall 6 opposite and parallel to each other; a front wall 7 and a rear wall 8 opposite and parallel to each other; and two parallel, opposite lateral walls 9.

Four longitudinal edges 10 are defined between front wall 7, rear wall 8, and lateral walls 9; and eight transverse edges 11 are defined between front wall 7, rear wall 8, and lateral walls 9.

Figure 2:
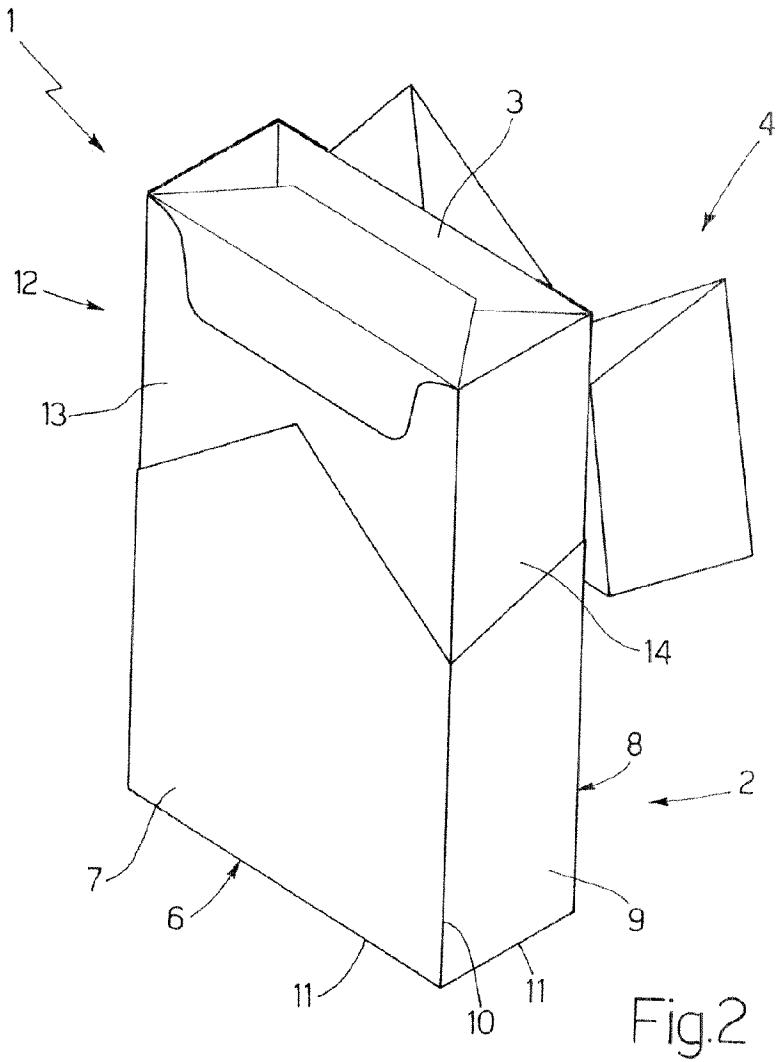
FIG. 2 shows a front view in perspective of the FIG. 1 packet of cigarettes in an open configuration.

In the FIGS. 1 and 2 embodiment, edges 10 and 11 are all square. In a different embodiment not shown, the four longitudinal edges 10 are non-square rounded or bevelled edges.

Alternatively, transverse edges 11 may be non-square rounded or bevelled edges, as in the packet of cigarettes described in Patent Application EP0764595A1. Both transverse edges 11 and longitudinal edges 10 may also be non-square rounded or bevelled edges.

In a different embodiment, packet 1 may resemble the packet of cigarettes described in Patent Application EP1066206A1, and comprise an outwardly convex front and rear wall, each of which has a flat central portion, and two curved, creased lateral bands connecting the flat central portion to two flat lateral walls of the packet at sharp longitudinal edges. In a further embodiment not shown, packet 1 may resemble the packet of cigarettes described in Patent Application WO003026984A1, and comprise an outwardly convex front and rear wall, each of which comprises a flat central portion, and two curved, creased lateral bands connecting the flat central portion to two flat walls of the packet at sharp transverse edges. Clearly, changes may be made to the above embodiments of packet 1, such as forming partly convex walls, or only one convex wall as opposed to two opposite convex walls.

Figure 6:
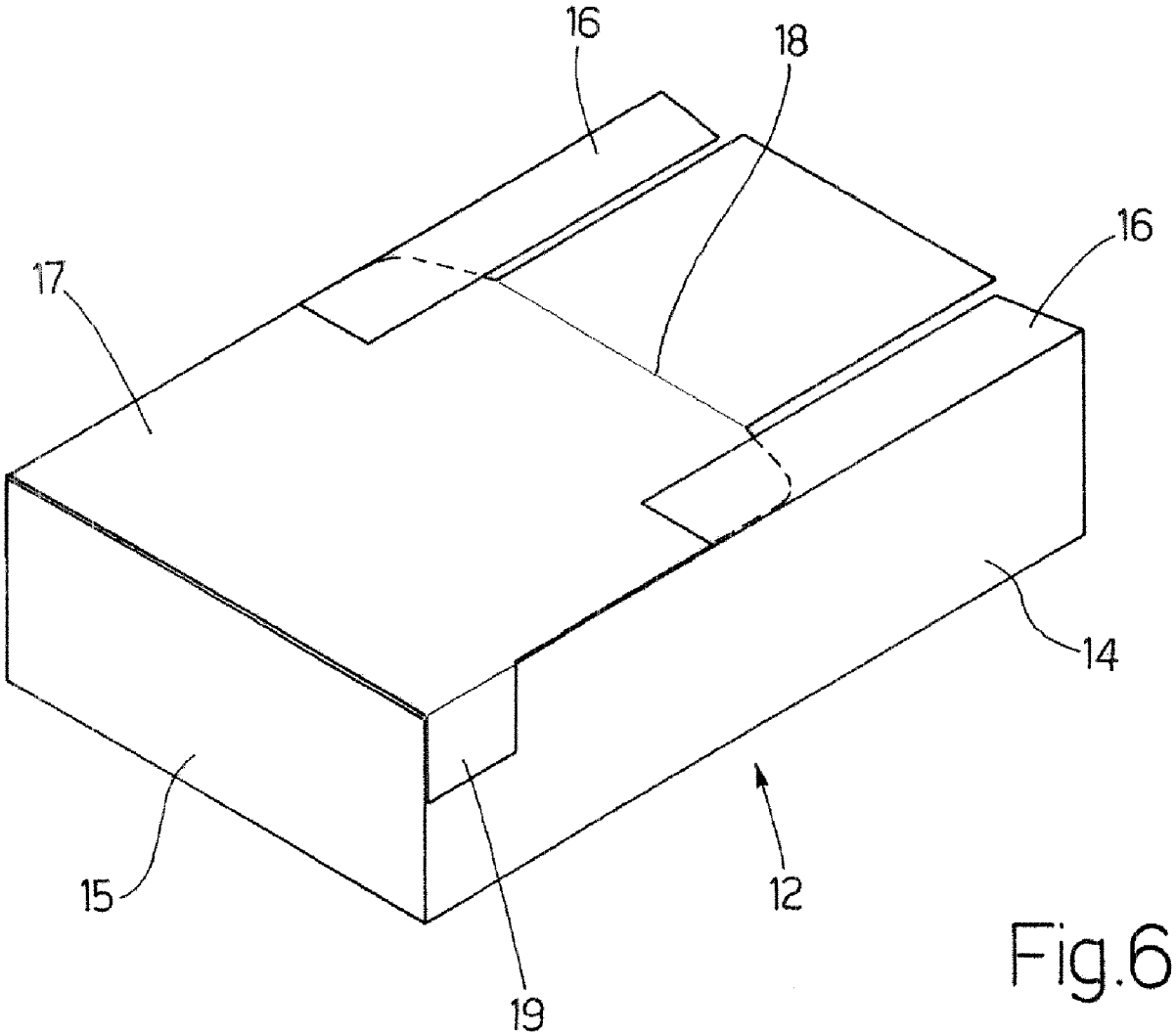
FIG. 6 shows a view in perspective of a collar and slide of the FIG. 1 packet of cigarettes, as positioned mutually when the lid is closed.
Figure 7:
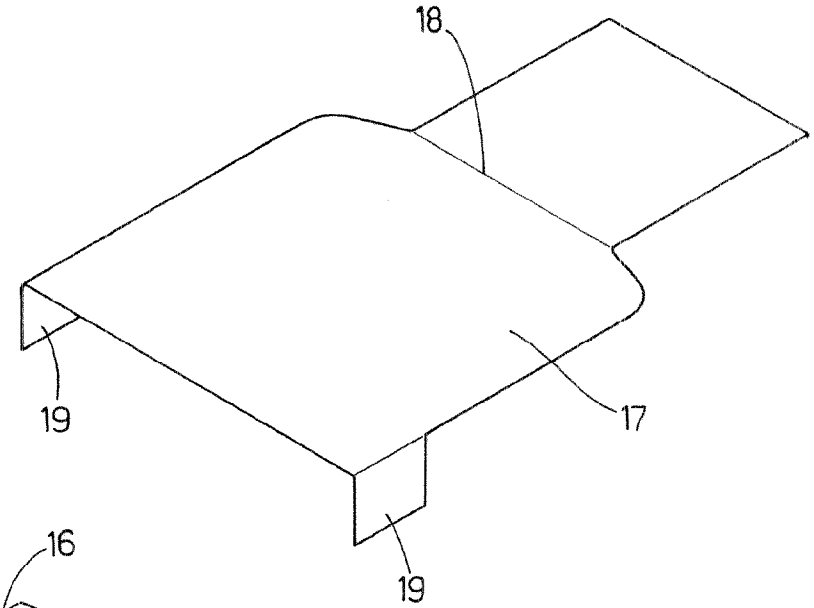
FIG. 7 shows an exploded view in perspective of the collar and slide in FIG. 6.
Figure 7:
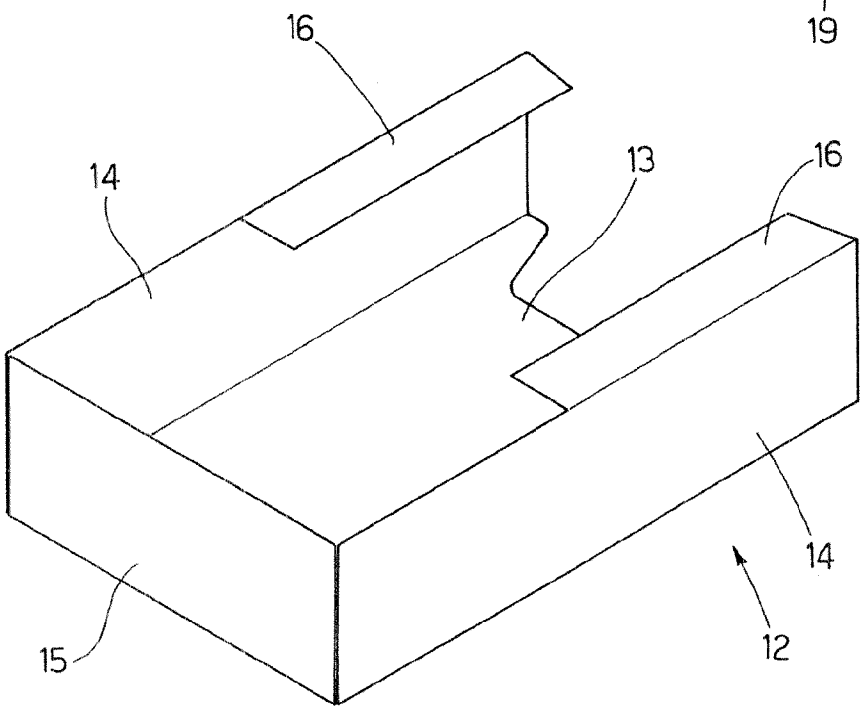

As shown in FIGS. 2, 6 and 7, packet 1 also comprises a collar 12, which surrounds the group of cigarettes, is glued to the inside of container 2, and projects partly outwards of the open top end to engage a corresponding inner surface of lid 4 when lid 4 is in the closed position.

As shown in FIGS. 6 and 7, collar 12 comprises a front wall 13, which contacts front wall 7 of container 2; two lateral walls 14 located on opposite sides of front wall 13, and which contact lateral walls 9 of container 2; and a bottom wall 15, which contacts bottom wall 6 of container 2. Each lateral wall 14 of collar 12 comprises a rear wing 16 folded squarely with respect to lateral wall 14 and contacting rear wall 8 of container 2.

Packet 1 also comprises a slide 17, which partly contacts rear wall 8 of container 2, has a top portion glued to lid 4, and has a hinge 18 of lid 4 to allow lid 4 to rotate with respect to container 2. Slide 17 only rests on rear wall 8 of container 2, so as to slide freely with respect to rear wall 8, and, preferably, is located underneath rear wings 16 of collar 12 (i.e. between rear wings 16 of collar 12 and inner package 3), and slides freely with respect to container 2, inner package 3, and collar 12.

In a preferred embodiment, slide 17 has two tabs 19 folded squarely with respect to slide 17 and against lateral walls 14 of collar 12, and which serve to limit upward slide of slide 17. More specifically, upward slide of slide 17 is arrested upon tabs 19 contacting rear wings 16 of collar 12.

Figure 5:
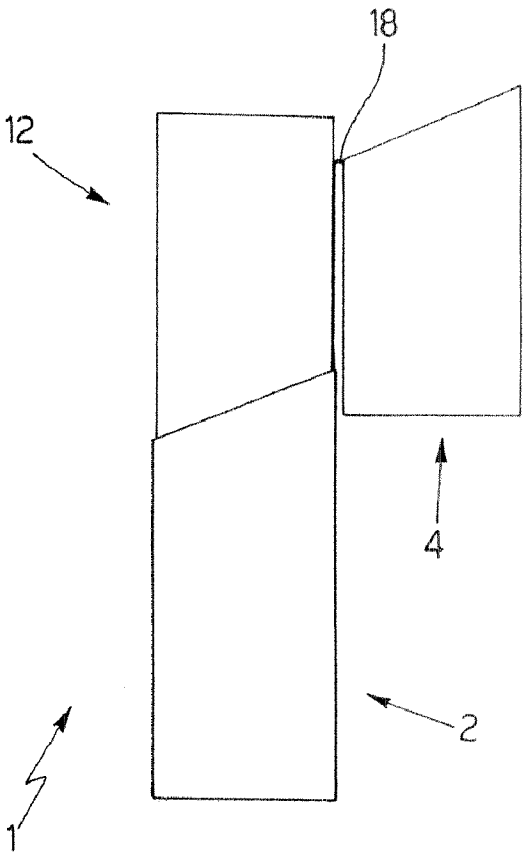
FIGS. 3, 4 and 5 show three side views of the FIG. 1 packet of cigarettes when opening the lid.
Figure 4:
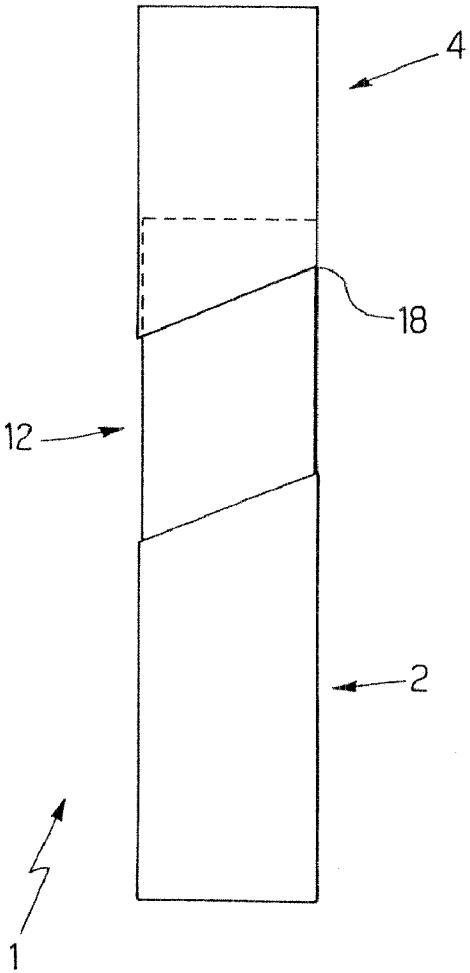
Figure 3:
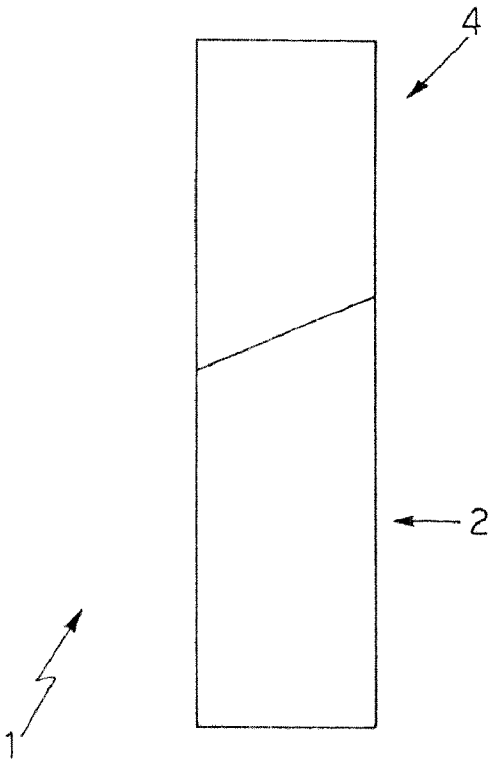

FIGS. 3, 4 and 5 show the lid 4 opening sequence. More specifically, FIG. 3 shows a side view of packet 1 of cigarettes with lid 4 in the closed position; FIG. 4 shows a side view of packet 1 of cigarettes with lid 4 in an intermediate position; and FIG. 5 shows a side view of packet 1 of cigarettes with lid 4 in the open position. To move from the closed to the open position, lid 4 is first translated longitudinally upwards with respect to container 2 (i.e. parallel to longitudinal edges 10). Lid 4 is raised with respect to container 2 by slide 17 sliding upwards, and comes to a stop upon tabs 19 of slide 17 contacting rear wings 16 of collar 12. Once raised fully with respect to container 2 (FIG. 4), lid 4 is rotated about hinge 18 with respect to container 2 into the open position (FIG. 5).

Figure 8:
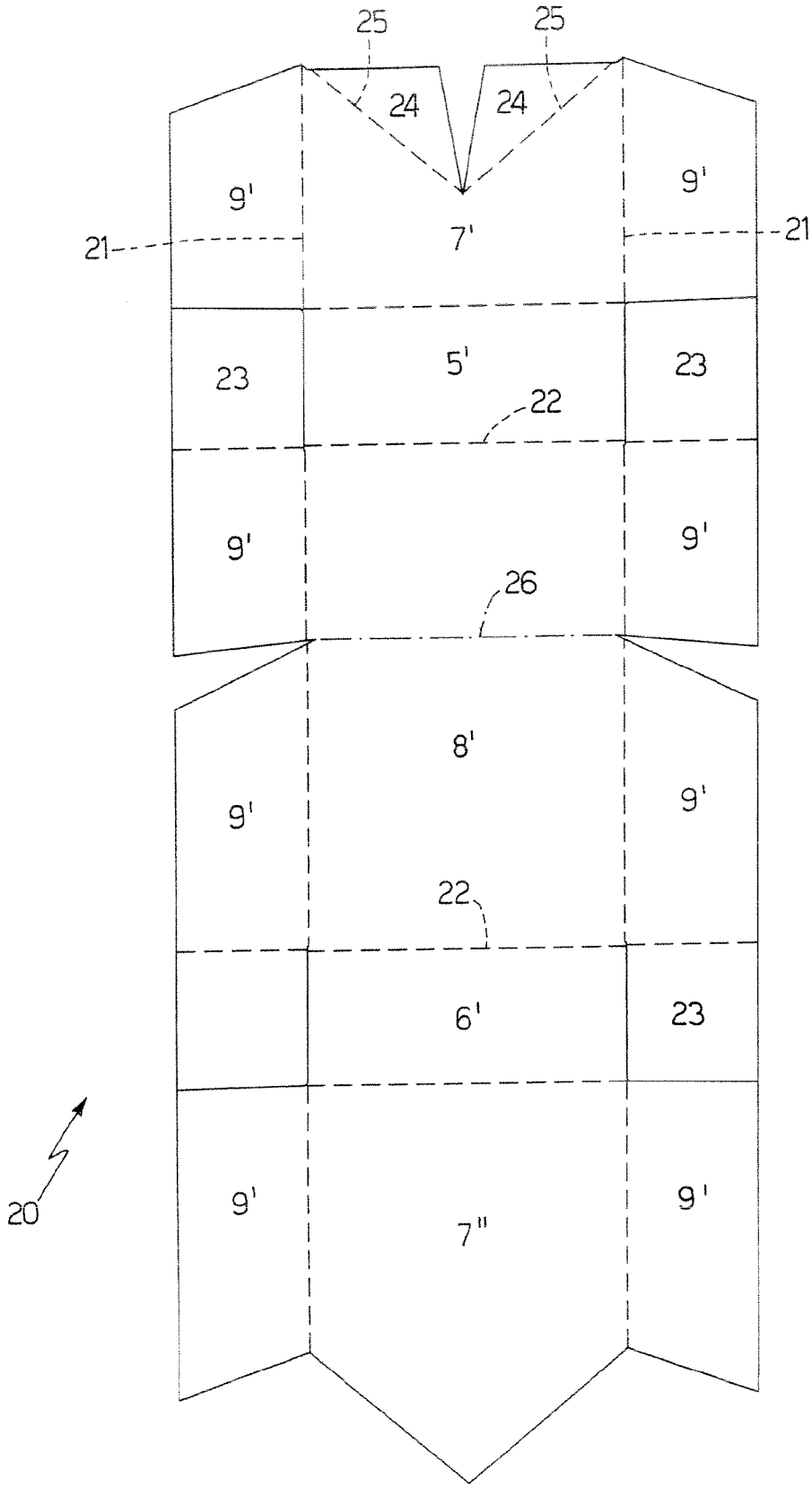
FIG. 8 shows a plan view of a flat blank by which to form an outer package of the FIG. 1 packet of cigarettes.
Figure 10:
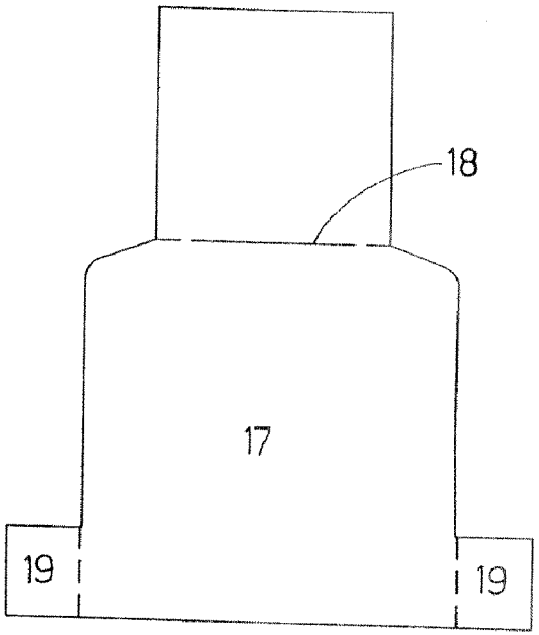
FIG. 10 shows a plan view of a flat slide, by which to form the FIG. 1 packet of cigarettes.
Figure 9:
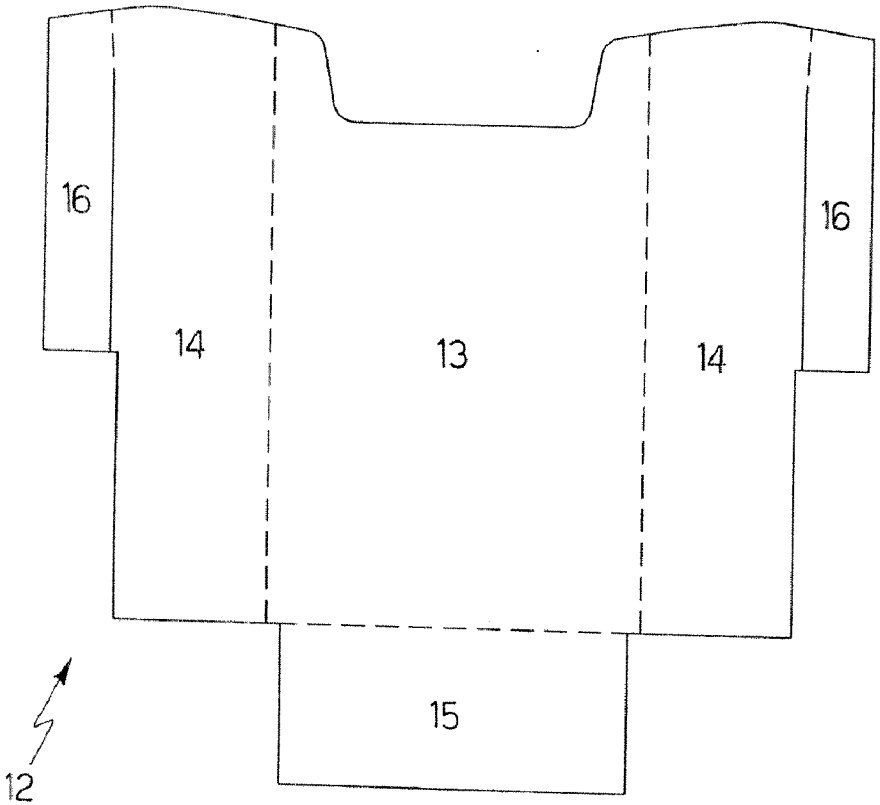
FIG. 9 shows a plan view of a flat collar, by which to form the FIG. 1 packet of cigarettes.

As shown in FIG. 8, container 2 is formed by folding a flat, substantially elongated rectangular blank 20 about inner package 3. In the following description, the component parts of blank 20 are indicated, where possible, using the same reference numbers, with superscripts, as for the corresponding parts of container 2.

Blank 20 has two longitudinal fold lines 21, and a number of transverse fold lines 22 defining, between the two longitudinal fold lines 21, a panel 7' forming a top portion of front wall 7 (more specifically, the portion forming part of lid 4); a panel 5' forming top wall 5; a panel 8' forming rear wall 8; a panel 6' forming bottom wall 6; and a panel 7" forming a bottom portion of front wall 7 (more specifically, the portion forming part of container 2).

Each panel 7', 7", 8' has two lateral wings 9', which are located on opposite sides of panel 7', 7", 81, are separated from panel 7', 7", 8' by longitudinal fold lines 21, and provide for forming lateral walls 9. Each wing 9' of panel 8' has two tabs 23 located at opposite ends of wing 91, and which provide for internally reinforcing top wall 5 and bottom wall 6 respectively.

Panel 7' has two lid 4 reinforcing flaps 24 separated from panel 7' by two oblique fold lines 25, which are oppositely inclined, and slope at a 45° angle with respect to both longitudinal fold lines 21 and transverse old lines 22. When folding blank 20—more specifically, at the initial folding stage of blank 20, before blank 20 is applied to inner package 3—reinforcing flaps 24 are folded 180° about oblique fold lines 25 onto panel 7'.

It is important to note that, in blank 20, lid 4 is connected to container 2 at rear wall 8, so, when forming packet 1 of cigarettes, a cut must be made along a parting line 26 (FIG. 8) of blank 20 to separate lid 4 from container 2 at rear wall 8. Preferably, blank 20 is cut along parting line 26 at rear wall 8 to completely separate lid 4 from container 2. Alternatively, blank 20 may be weakened (e.g. by an intermittent cut) along parting line 26 at rear wall 8, to form a tear-off line of parting line 26, along which the user tears lid 4 off container 2 when unsealing packet 1 of cigarettes.

Figure 11:
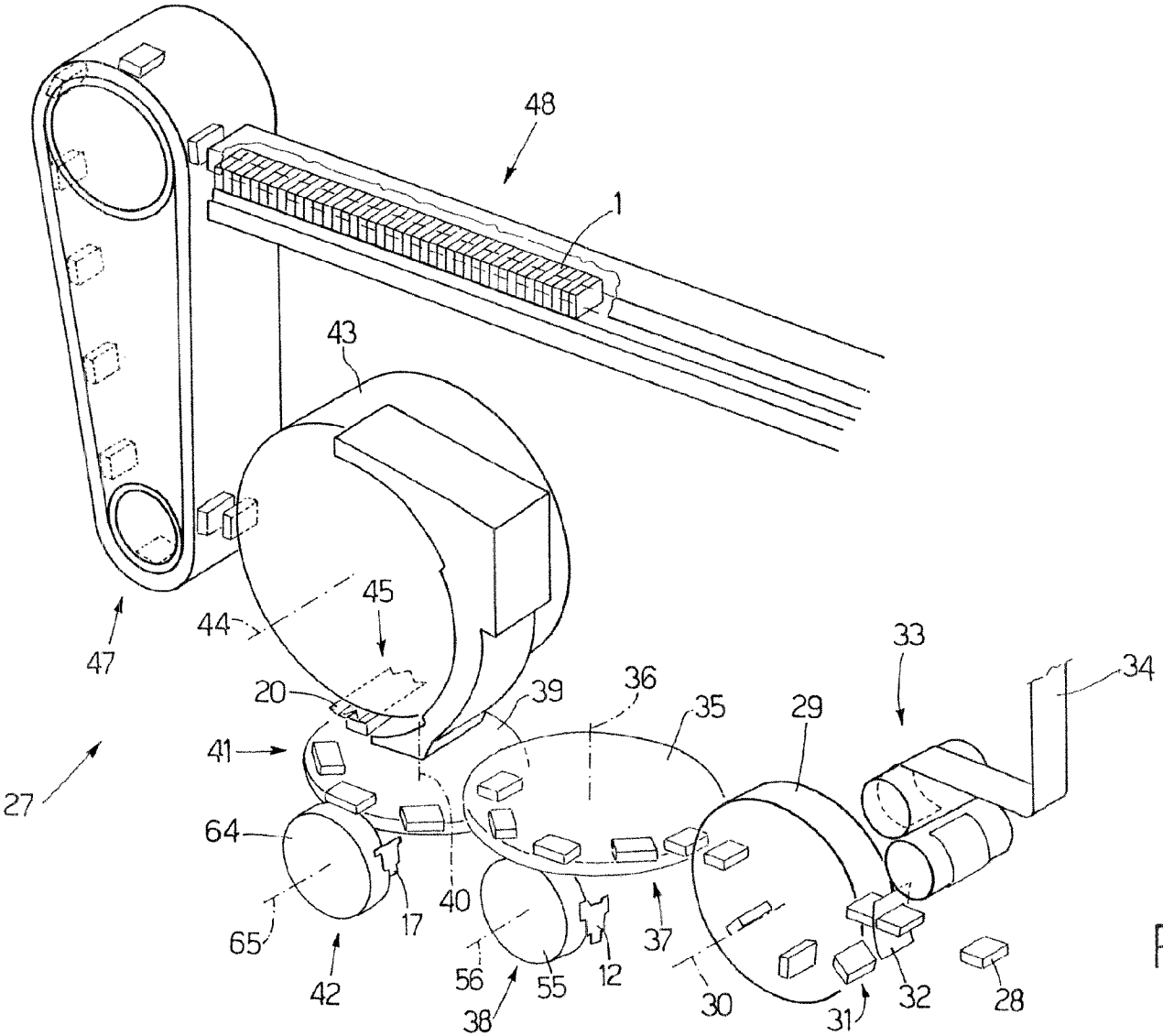
FIG. 11 shows a schematic view in perspective, with parts removed for clarity, of a cigarette packing machine in accordance with the present invention and for producing the FIG. 1 packet of cigarettes.

Number 27 in FIG. 11 indicates as a whole a packing machine for producing packets 1 of cigarettes as described above. Packing machine 27 comprises a forming unit (not shown) for forming groups 28 of cigarettes; and a vertical packing wheel 29 rotating in steps about a horizontal axis of rotation 30. Packing wheel 29 comprises a number of peripheral pockets 31, each of which receives a group 28 of cigarettes from the forming unit, and a sheet 32 of foil packing material from a feed unit 33, which cuts the individual sheets 32 of packing material off a continuous strip 34 unwound off a reel.

Packing machine 27 also comprises a horizontal packing wheel 35 rotating in steps about a vertical axis 36, and having a number of peripheral pockets 37, each of which is supplied downwards with an inner package 3 from a pocket 31 of packing wheel 29, and then upwards with a collar 12 from a feed unit 38. Each collar 12 is fed flat to pocket 37 of packing wheel 35, and is folded about package 3 when package 3 is pushed out of pocket 37.

Packing machine 27 also comprises a horizontal packing wheel 39, which rotates in steps about a vertical axis 40, is located below packing wheel 35, and had a number of peripheral pockets 41, each of which is supplied downwards with an inner package 3, complete with a collar 12, from a pocket 37 of packing wheel 35, and then downwards with a slide 17 from a feed unit 42. It is important to note that packing wheel 35 overlaps packing wheel 39, so that a pocket 37 of packing wheel 35 is superimposed over and aligned perfectly with a pocket 41 of packing wheel 39, and inner package 3 can be transferred vertically from pocket 37 of packing wheel 35 to pocket 41 of packing wheel 39.

Packing wheel 39 is equipped with fixed (helical) folding devices (not shown) located downstream from feed unit 42 in the rotation direction of packing wheel 39, and which fold rear wings 16 of each collar 12 onto inner package 3 and over slide 17. Tabs 19 of each slide 17, on the other hand, are folded onto inner package 3 and onto lateral walls 14 of collar 12 as inner package 3 is transferred from pocket 41 of packing wheel 39.

Finally, packing machine 27 also comprises a vertical packing wheel 43 rotating in steps about a horizontal axis 44, and having a number of peripheral pockets 45, each of which receives a blank 20 from a feed unit 46 (FIG. 14), and then an inner package 3, complete with a collar 12 and a slide 17, from a pocket 41 of packing wheel 39. Packing wheel 43 folds each blank 20 about an inner package 3 and over collar 12 and slide 17, and the folding of each blank 20 is completed to form a packet 1 of cigarettes, as packet 1 of cigarettes is expelled from pocket 45 of packing wheel 43.

Downstream from packing wheel 43, a vertical transfer conveyor 47 successively receives and transfers packets 1 of cigarettes from packing wheel 43 to a horizontal drying conveyor 48.

As stated, when forming each packet 1 of cigarettes, a cut must be made along parting line 26 (FIG. 8) of blank 20 to separate lid 4 from container 2 at rear wall 8. The cut may be either one separating lid 4 from container 2 at the outset, or in the form of a tear line along which the lid is torn off container 2 when packet 1 is unsealed. The cut along parting line 26 of each blank 20 is made by a cutting device, which may be located downstream from drying conveyor 48, at a feed station supplying a cellophaning machine (not shown). Alternatively, the cutting device may be located along transfer conveyor 47 or along packing wheel 43. If only a tear line is formed along parting line 26 of each blank 20, the cutting device may even be located at blank 20 feed unit 46. In this connection, it should be pointed out that, each blank 20 cannot be cut completely along parting line 26 until at least part of blank 20 has been folded about respective inner package 3.

Figure 12:
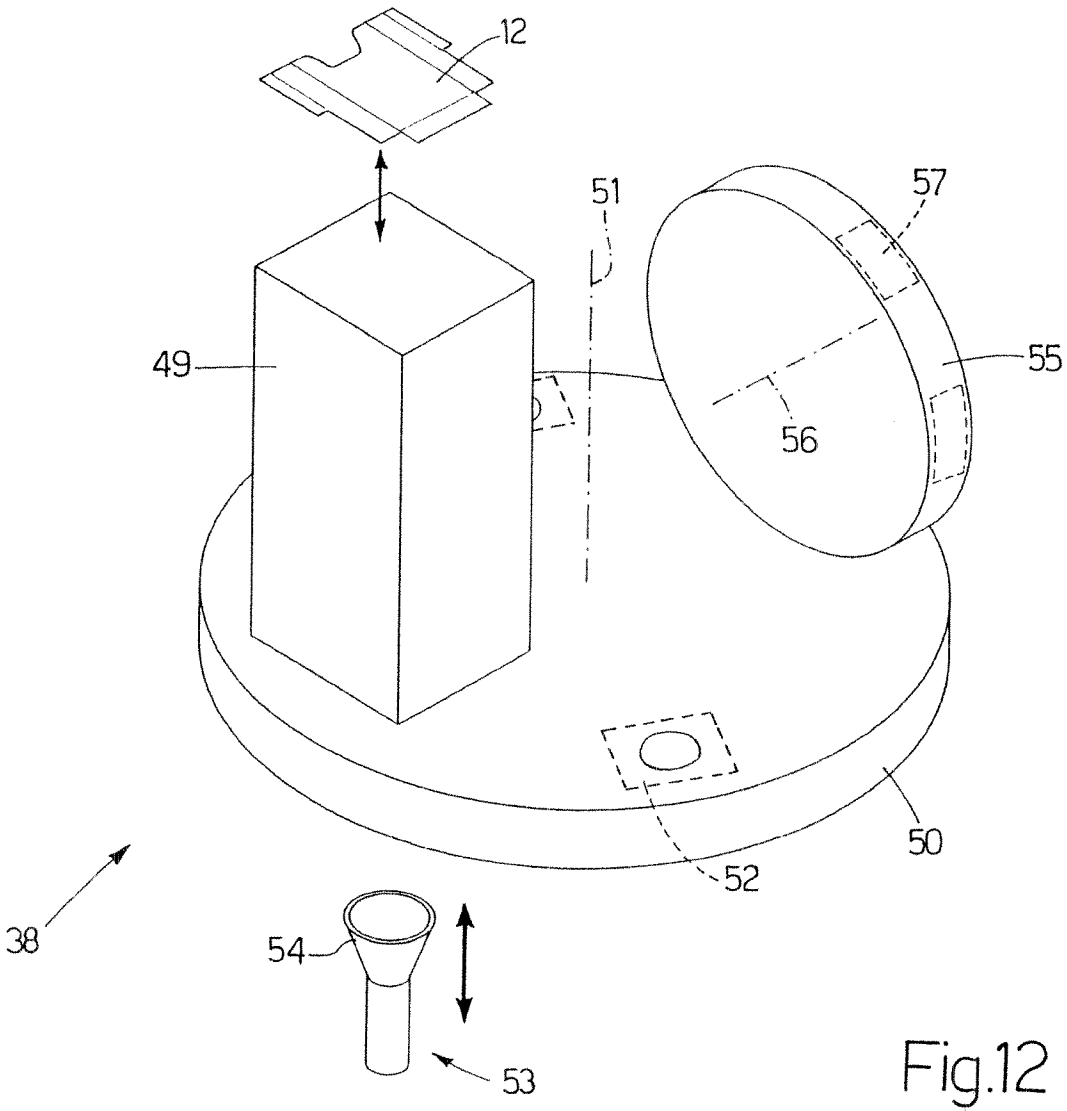
FIG. 12 shows a schematic view in perspective, with parts removed for clarity, of a collar feed unit of the FIG. 11 cigarette packing machine.

As shown in FIG. 12, collar 12 feed unit 38 comprises a vertical hopper 49 housing a stack of collars 12 and having a bottom outlet located over a horizontal pickup wheel 50, which rotates in steps about a vertical axis of rotation 51, and has a number of peripheral suction seats 52. A pickup device 53 withdraws collars 12 successively from the bottom outlet of hopper 49, and feeds collars 12 to suction seats 52 of pickup wheel 50. More specifically, pickup device 53 comprises a suction pickup head 54, which moves vertically up and down through a suction seat 52 of pickup wheel 50 arrested facing the bottom outlet of hopper 49.

Collar 12 feed unit 38 also comprises a vertical feed wheel 55 rotating in steps about a horizontal axis of rotation 56, and having a number of peripheral suction seats 57. Feed wheel 55 is located between pickup wheel 50 and packing wheel 35 (i.e. over pickup wheel 50 and beneath packing wheel 35) to receive collars 12 successively from pickup wheel 50 and feed collars 12 upwards to packing wheel 35.

In a different embodiment not shown, feed unit 38 comprises a further vertical hopper housing a stack of coupons (e.g. vouchers or leaflets) and having a bottom outlet located over pickup wheel 50, upstream from vertical hopper 49 in the rotation direction of pickup wheel 50. The further hopper provides for also supplying coupons, each of which is inserted inside a packet 1 of cigarettes, between inner package 3 and collar 12. If the further coupon hopper is also provided, each suction seat 52 of pickup wheel 50 has two different suction areas, one for retaining a collar 12, and the other for retaining a coupon. This configuration is made possible by virtue of the different shape and size of collar 12 and the coupon, so that bottom portions of a collar 12 superimposed on a coupon are always left exposed by the coupon.

Figure 13:
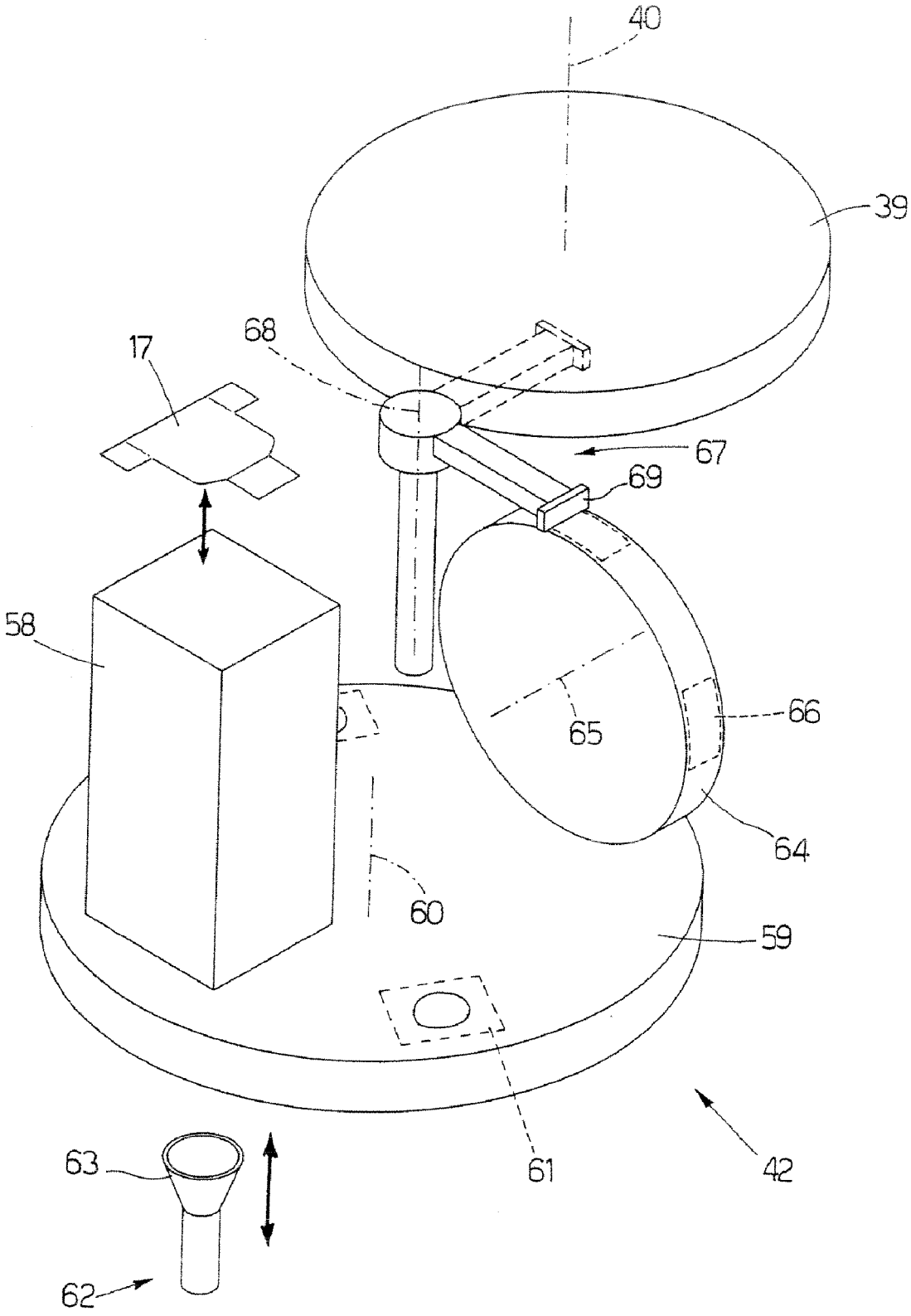
FIG. 13 shows a schematic view in perspective, with parts removed for clarity, of a slide feed unit of the FIG. 11 cigarette packing machine.

As shown in FIG. 13, slide 17 feed unit 42 is very similar to collar 12 feed unit 38, and comprises a vertical hopper 58 housing a stack of slides 17 and having a bottom outlet located over a horizontal pickup wheel 59, which rotates in steps about a vertical axis of rotation 60, and has a number of peripheral suction seats 61. A pickup device 62 withdraws slides 17 successively from the bottom outlet of hopper 58, and feeds slides 17 to suction seats 61 of pickup wheel 59. More specifically, pickup device 62 comprises a suction pickup head 63, which moves vertically up and down through a suction seat 61 of pickup wheel 59 arrested facing the bottom outlet of hopper 58.

Slide 17 feed unit 42 also comprises a vertical feed wheel 64 rotating in steps about a horizontal axis of rotation 65, and having a number of peripheral suction seats 66. Feed wheel 64 is located over pickup wheel 59 and alongside packing wheel 39, so as to receive slides 17 successively from pickup wheel 59 and feed slides 17 to packing wheel 39. More specifically, each slide 17 is fed from a suction seat 66 of feed wheel 64 to a pocket 41 of packing wheel 39 by a horizontal feed arm 67, which rotates back and forth about a vertical axis of rotation 68 to move a suction pickup head 69 cyclically from a suction seat 66 of feed wheel 64 to a pocket 41 of packing wheel 39, and vice versa.

It should be pointed out that feed wheel 55 is located beneath packing wheel 35 to feed collars 12 upwards into pockets 37 of packing wheel 35; whereas feed wheel 64 is located alongside packing wheel 39 and connected to feed arm 67 to feed slides 17 downwards into pockets 41 of packing wheel 39.

Figure 18:
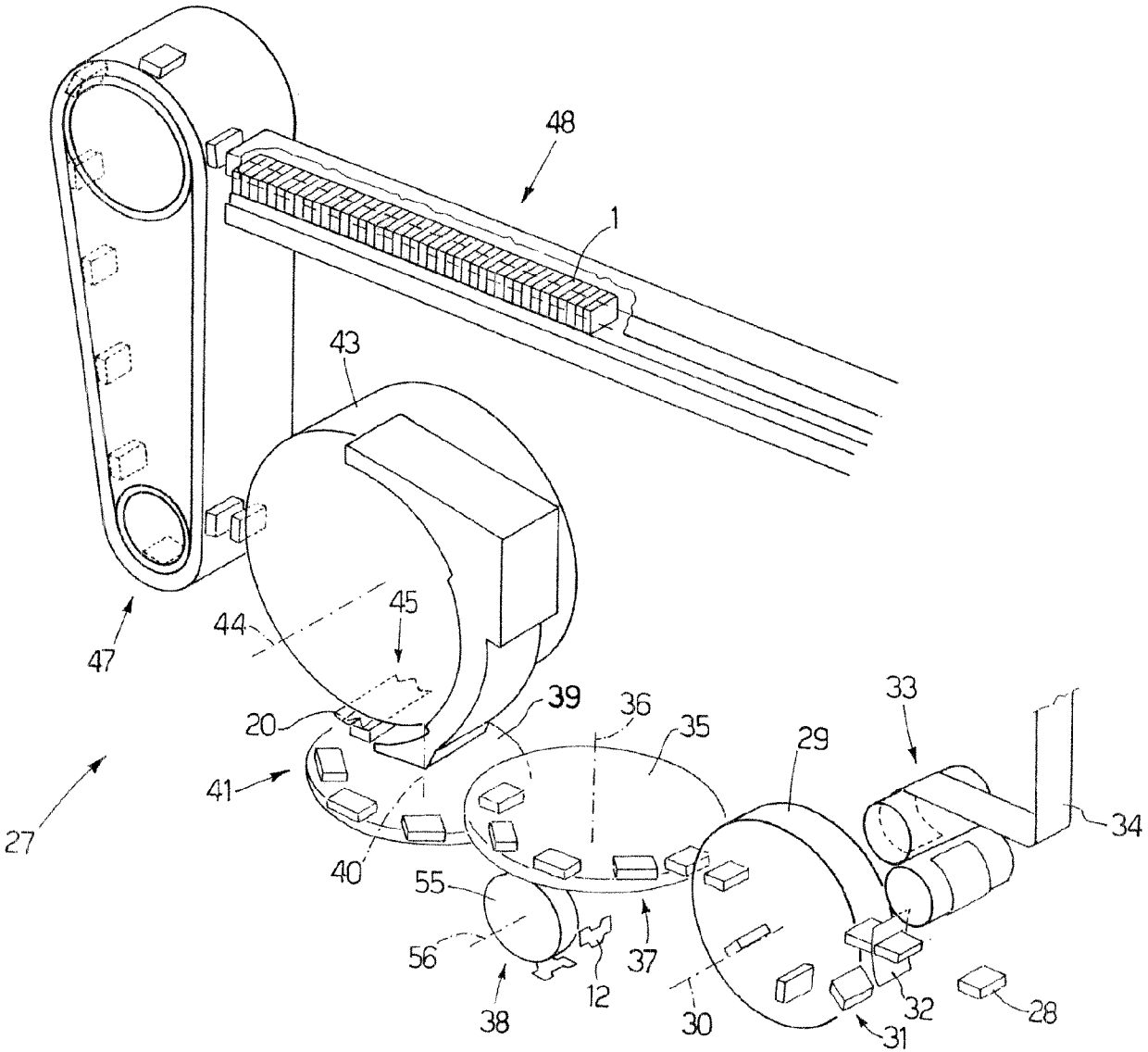
FIG. 18 shows a schematic view in perspective, with parts removed for clarity, of a variation of the FIG. 11 packing machine.

In a different embodiment shown in FIG. 18, packing machine 27 produces a conventional packet 1 of cigarettes having no slide 17, and wherein hinge 18 of lid 4 is therefore fixed (i.e. not movable longitudinally, as in the FIG. 1-5 packet 1 of cigarettes) and located on rear wall 8 of container 2. In which case, slide 17 feed unit 42 is obviously eliminated (or at any rate is not active). Alternatively, feed unit 42 may be used to supply any type of material, such as coupons (vouchers or leaflets) or reinforcing panels, to be inserted between inner package 3 and rear wall 8 of container 2.

Figure 14:
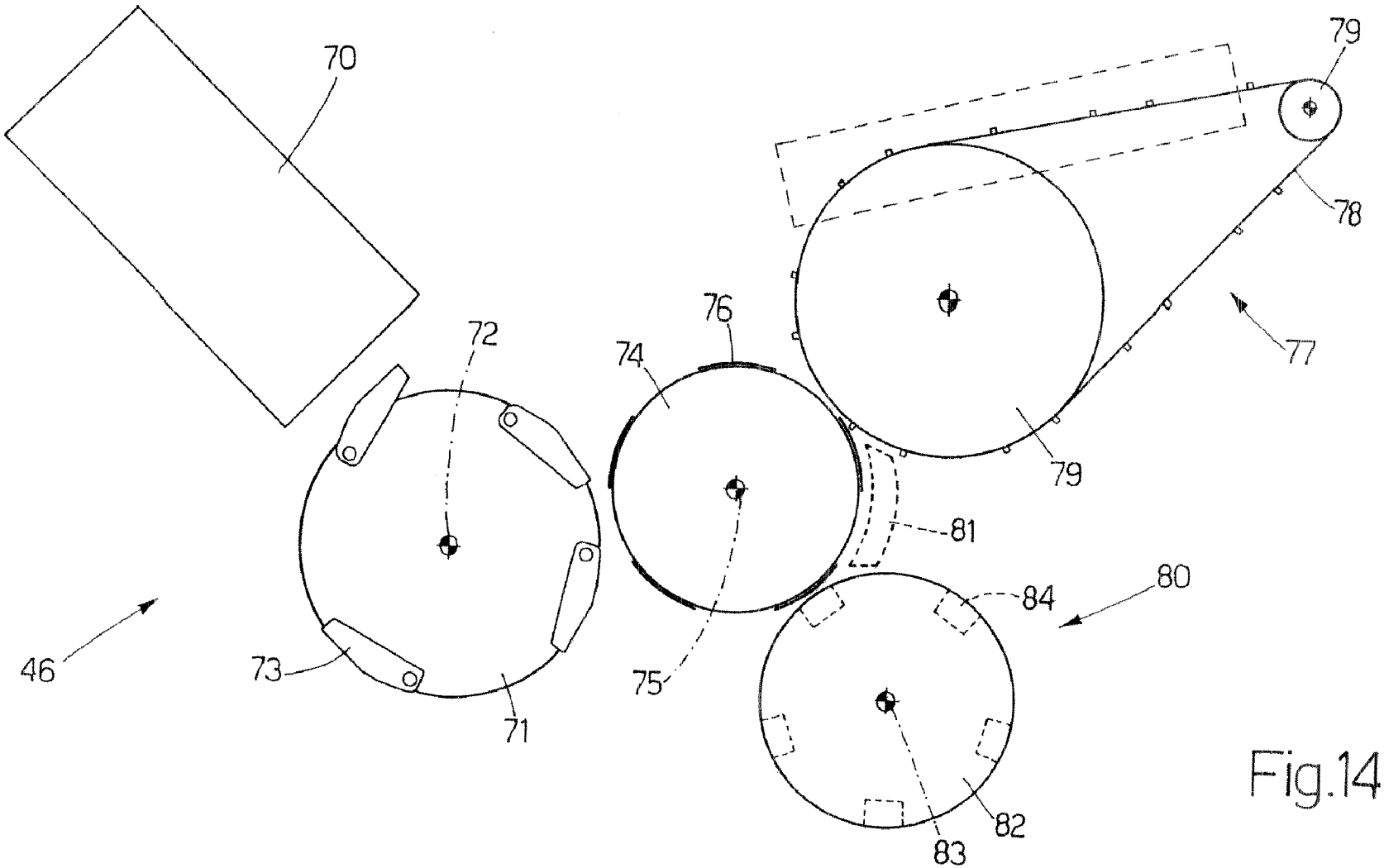
FIG. 14 shows a schematic front view, with parts removed for clarity, of a blank feed unit of the FIG. 11 cigarette packing machine.

As shown in FIG. 14, blank 20 feed unit 46 comprises a tilted hopper 70 housing a stack of blanks 20 and having a bottom outlet through which blanks 20 are withdrawn one by one. Feed unit 46 comprises a vertical pickup wheel 71 rotating about a horizontal axis of rotation 72, and supporting a number of suction pickup heads 73; and each suction pickup head 73 is hinged to pickup wheel 71 to rotate, with respect to pickup wheel 71 and under the control of a cam actuating system, about an axis of rotation parallel to axis of rotation 72.

Feed unit 46 also comprises a vertical intermediate wheel 74 rotating about a horizontal axis of rotation 75, and having a number of suction seats 76; and a belt feed conveyor 77 having a belt 78, which is looped about two end pulleys 79 and located partly beneath packing wheel 43. More specifically, belt 78 of feed conveyor 77 has a number of projections, which push blanks 20 along a feed path defined by fixed guide rails.

In actual use, each suction pickup head 73 of pickup wheel 71 engages the bottom outlet of hopper 70 to withdraw a blank 20 from the stack; the blank 20 is then transferred by suction pickup head 73 of pickup wheel 71 to a suction seat 76 of intermediate wheel 74, and then from suction seat 76 of intermediate wheel 74 to feed conveyor 77; and, finally, feed conveyor 77 feeds blank 20 into a pocket 45 of packing wheel 43.

A known roller or spray gumming device (not shown) is located at intermediate wheel 74 to gum each blank 20. A folding device 80 is also located at intermediate wheel 74 to prefold the two reinforcing flaps 24 of lid 4 of each blank 20 about oblique fold lines 25. For example, prefolding of the two reinforcing flaps 24 comprises folding the two reinforcing flaps 24 about oblique fold lines 25 by an angle of at least 90° and generally no more than 100-110°. Folding the two reinforcing flaps 24 of lid 4 of each blank 20 is completed by a further folding device 81 having fixed folding rails (or fixed helical folding devices). In FIG. 14, folding device 81 is located at intermediate wheel 74, downstream from folding device 80, but may alternatively be located at feed conveyor 77.

Folding device 80 is essential to fold reinforcing flaps 24 of each blank 20 a hundred and eighty degrees about oblique fold lines 25 onto panel 7'. That is, oblique fold lines 25 being oppositely inclined lengthwise of blank 20, at least one of the two reinforcing flaps 24 could never be folded 180° by a fixed folding rail (which cannot fold against the travelling direction of blank 20). By means of folding device 80, on other hand, both reinforcing flaps 24 are prefolded at least 90° with respect to blank 20, and folding is then completed by the folding rails of folding device 81.

Figure 17:
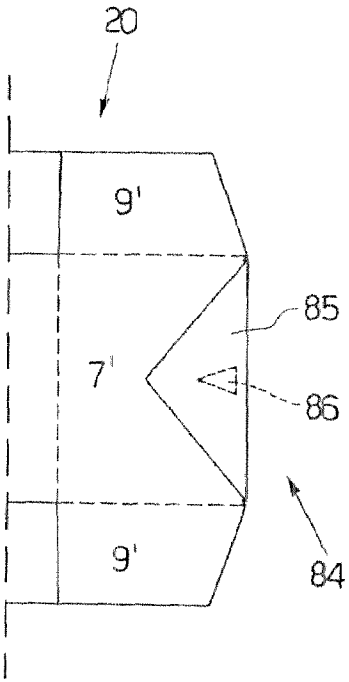
FIGS. 15, 16 and 17 show, schematically, a folding sequence performed by a folding device of the FIG. 14 blank feed unit to fold two lid reinforcing flaps of the FIG. 8 blank.
Figure 17:
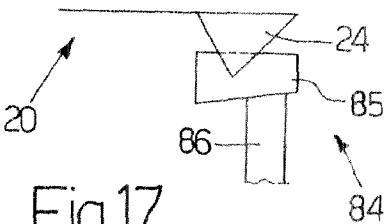
Figure 16:
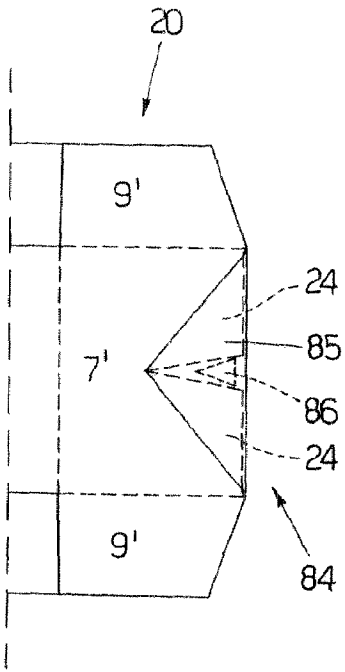
Figure 16:
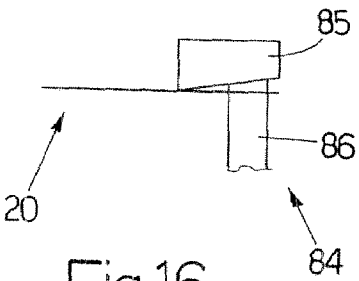
Figure 15:
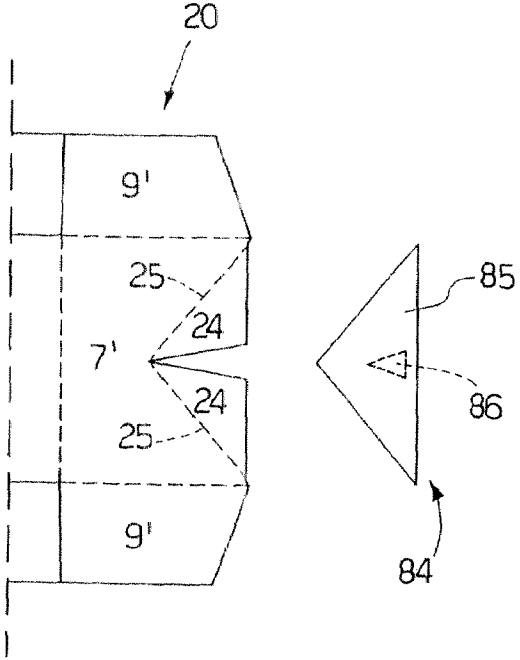
Figure 15:
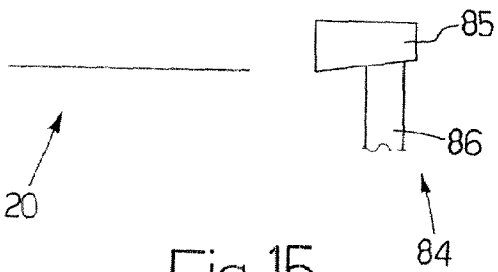

In a preferred embodiment, folding device 80 comprises a vertical folding wheel 82 rotating about a horizontal axis of rotation 83, and supporting a number of folding bodies 84 equally spaced about the periphery of folding wheel 82. As shown in FIGS. 15-17, each folding body 84 comprises a wedge-shaped, triangular-section folding head 85; and a connecting rod 86 fitted movably to folding wheel 82 and operated by a cam actuating system (not shown). It is important to note that folding head 85 has a triangular section to match the shape of oblique fold lines 25, about which the two reinforcing flaps 24 are folded.

In actual use, each folding body 84 is inserted between the two reinforcing flaps 24 to position folding head 85 on blank 20 (FIG. 16); and folding body 84 is then lowered with respect to blank 20, so that folding head 85 folds the two reinforcing flaps 24 ninety degrees with respect to blank 20 (FIG. 17).

Collar 12 feed unit 38 as described above has numerous advantages: it provides for withdrawing collars 12 from a stack of superimposed collars, and can be integrated quickly and easily in an existing packing machine (in particular, G.D. packing machine X3000 or X6), while at the same time impairing none of the structural or dimensional factors involved, and ensuring adequate access to all the component parts of the packing machine.

Moreover, by virtue of slide 17 feed unit 42, packing machine 27 can efficiently produce the FIG. 1-5 packet 1 of cigarettes, which calls for feeding a collar 12 onto a front wall of inner package 3, and a slide 17 onto a rear wall of inner package 3.

Finally, by virtue of folding device 80, the two reinforcing flaps 24 of each blank 20 can be folded easily and effectively 180° about the two oblique fold lines 25, despite at least one of the two oblique fold lines 25 calling for folding against the travelling direction of blank 20.

The invention claimed is:

1. A method of folding a reinforcing flap of the lid of a rigid, hinged-lid packet of cigarettes wherein two reinforcing flaps (24) of the lid (4) are folded 180° with respect to a blank (20), onto a front wall (7) of the lid (4), and about two respective oblique fold lines (25), which are oppositely inclined; the method comprising the steps of:

prefolding the reinforcing flaps (24) about the oblique fold lines (25) by means of a first folding device (80) having a movable folding body (84) which folds the reinforcing flaps (24) about the oblique fold lines (25); and completing folding of the reinforcing flaps (24) about the oblique fold lines (25) by means of a second folding device (81) having fixed folding rails which directly contact the reinforcing flaps (24) and fold the reinforcing flaps (24) about the oblique fold lines (25), onto the front wall (7) of the lid (4), and 180° with respect to the blank (20).

2. A method as claimed in claim 1, wherein prefolding comprises folding each reinforcing flap (24) about the fold line (25) by an angle ranging between 90° and 110°.

3. A method as claimed in claim 1, and comprising the further steps of:

positioning a folding head (85) of the folding body (84) on the blank (20); and lowering the folding body (84) with respect to the blank (20) so that the folding head (85) folds each reinforcing flap (24) at least 90° with respect to the blank (20).

4. A method as claimed in claim 3, wherein the folding body (84) is inserted between the two reinforcing flaps (24) to position the folding head (85) on the blank (20).

5. A method as claimed in claim 4, wherein the folding head (85) is wedge-shaped with a triangular cross section, and is fitted to a connecting rod (86).

6. A method as claimed in claim 1, wherein the first folding device (80) comprises a folding wheel (82) rotating about an axis of rotation (83), and supporting a number of folding bodies (84) equally spaced about the periphery of the folding wheel (82); and each folding body (84) comprises a folding head (85), and a connecting rod (86) fitted movably to the folding wheel (82) and operated by a cam actuating system.

7. A method as claimed in claim 1, and comprising the further step, once the reinforcing flaps (24) is are folded, of feeding the blank (20) to a pocket (45) of a packing wheel (43), in which the blank (20) is folded about an inner package (3) to form the packet (1) of cigarettes.

8. A feed unit for folding a reinforcing flap of the lid of a rigid, hinged-lid packet of cigarettes, wherein two reinforcing flaps (24) of the lid (4) are folded 180° with respect to a blank (20), onto a front wall (7) of the lid (4), and about two respective oblique fold lines (25), which are oppositely inclined; the feed unit (46) comprising:

a first folding device (80) having a movable folding body (84) which prefolds the reinforcing flaps (24) about the oblique fold lines (25); and a second folding device (81) having fixed folding rails which directly contact the reinforcing flaps (24) and fold the reinforcing flaps (24) about the oblique fold lines (25), onto a front wall (7) of the lid (4), and 180° with respect to the blank (20) to complete folding of the reinforcing flaps (24) about the oblique fold lines (25).

9. A feed unit as claimed in claim 8, wherein prefolding comprises folding each reinforcing flap (24) about the fold line (25) by an angle ranging between 90° and 110°.

10. A feed unit as claimed in claim 8, wherein, in use, the folding head (85) of the folding body (84) is positioned on the blank (20), and the folding body (84) is lowered with respect to the blank (20) so that folding head (85) folds the each reinforcing flap (24) at least 90° with respect to the blank (20).

11. A feed unit as claimed in claim 10, wherein, in use, the folding body (84) is inserted between the two reinforcing flaps (24) to position the folding head (85) on the blank (20).

12. A feed unit as claimed in claim 11, wherein the folding head (85) is wedge-shaped with a triangular cross section, and is fitted to a connecting rod (86).

13. A feed unit as claimed in claim 8, wherein the first folding device (80) comprises a folding wheel (82) rotating about a first axis of rotation (83), and supporting a number of folding bodies (84) equally spaced about the periphery of the folding wheel (82); and each folding body (84) comprises a folding head (85), and a connecting rod (86) fitted movably to the folding wheel (82) and operated by a cam actuating system.

14. A feed unit as claimed in claim 8, and comprising:

a hopper (70) housing a stack of blanks (20), and having a bottom outlet through which the blanks (20) are withdrawn one by one;

a vertical pickup wheel (71) rotating about a horizontal second axis of rotation (72), and supporting a number of suction pickup heads (73);

a vertical intermediate wheel (74) rotating about a horizontal third axis of rotation (75), and having a number of suction seats (76); and a belt feed conveyor (77), which has a belt (78) looped about two end pulleys (79), and is located partly beneath a packing wheel (43) on which each blank (20) is folded about an inner package (3) to form a packet (1) of cigarettes.

15. A feed unit as claimed in claim 14, wherein each suction pickup head (73) is hinged to the pickup wheel (71) to rotate, with respect to the pickup wheel (71) and under the control of a cam actuating system, about a fourth axis of rotation parallel to the second axis of rotation (72).

16. A feed unit as claimed in claim 14, and comprising a gumming device located at the intermediate wheel (74) to gum each blank (20).

17. A feed unit as claimed in claim 14, wherein the first folding device (80) is located at the intermediate wheel (74), and the second folding device (81) is located at the feed conveyor (77).

18. A feed unit as claimed in claim 14, wherein the first folding device (80) is located at the intermediate wheel (74), and the second folding device (81) is located at the intermediate wheel (74), downstream from the first folding device (80).

* * * * *